US006785486B2

(12) United States Patent
Yoshida et al.

(10) Patent No.: US 6,785,486 B2
(45) Date of Patent: Aug. 31, 2004

(54) IMAGE FORMING APPARATUS

(75) Inventors: Minoru Yoshida, Tokyo (JP); Takao Izumi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/289,204

(22) Filed: Nov. 7, 2002

(65) Prior Publication Data

US 2004/0091276 A1 May 13, 2004

(51) Int. Cl.[7] ..... G03G 15/16; G03G 21/00
(52) U.S. Cl. ..... 399/71; 399/101; 399/346
(58) Field of Search ..... 399/71, 9, 44, 399/94, 97, 98, 101, 302, 308, 346

(56) References Cited

U.S. PATENT DOCUMENTS

| | | | | |
|---|---|---|---|---|
| 5,237,374 A | | 8/1993 | Ueno et al. | |
| 5,585,906 A | | 12/1996 | Takahashi et al. | |
| 5,794,110 A | | 8/1998 | Kasai et al. | |
| 5,812,919 A | * | 9/1998 | Takano et al. | 399/346 X |
| 6,078,777 A | | 6/2000 | Imumi et al. | |
| 6,160,977 A | * | 12/2000 | Takeichi et al. | 399/346 |
| 6,330,420 B1 | * | 12/2001 | Honda | 399/346 |
| 6,337,967 B1 | | 1/2002 | Izumi et al. | |

FOREIGN PATENT DOCUMENTS

| | | | |
|---|---|---|---|
| JP | 61-153684 A | | 7/1986 |
| JP | 1-293380 A | | 11/1989 |
| JP | 07-311531 | * | 11/1995 |
| JP | 11-212379 A | | 8/1999 |
| JP | 11-327318 A | | 11/1999 |
| JP | 2000-231280 A | | 8/2000 |
| JP | 2001-100591 | * | 4/2001 |
| JP | 2002-341694 | * | 11/2002 |

* cited by examiner

*Primary Examiner*—Sophia S. Chen
(74) *Attorney, Agent, or Firm*—Foley & Lardner LLP

(57) ABSTRACT

A image forming apparatus comprising a cleaning blade for cleaning a conveying belt or an intermediate transfer body, and a lubricating agent coating mechanism for coating a lubricating agent on the surface of the conveying belt or the intermediate transfer body, wherein detection is made whether a conveying belt, an intermediate transfer body belt or a cleaning blade is a new article, and the lubricating agent coating mechanism is operated to coat the lubricating agent on the surface of the conveying belt or the intermediate transfer body. Further, detection is made of installation temperature and humidity of the image forming apparatus, and in case of under-prescribed environments, the lubricating agent coating mechanism is operated to coat the lubricating agent on the surface of the conveying belt or the intermediate transfer body. Thereby, the cleaning performance is improved, and the blade burring is prevented.

3 Claims, 8 Drawing Sheets

IMAGE FORMING APPARATUS

BACKGROUND OF THE INVENTION

1. Field of the Invention

The present invention relates to an image forming apparatus employing an electrophotographic process such as a laser printer, an electrophotographic copying machine and so on, and particularly to a color image forming apparatus employing an electrophotographic process.

2. Related Art Statement

As a color image forming apparatus employing an electrophotographic process, there have been widely employed a system in which toner images are formed color by color on a photosensitive body, the resultant toner images are primarily transferred onto an intermediate transfer body to form an overcolor toner image, and the images are transferred collectively onto a paper by a secondary transfer; and a quadruple tandem system in which in four image forming stations having a photosensitive body, toner images of respective colors are formed, and the toner images of respective colors are transferred in order onto a paper being conveyed by a conveying belt.

The aforementioned intermediate transfer body and the conveying belt normally have a cleaner for cleaning the surfaces thereof attached thereto. As for the intermediate transfer body, it is necessary to mount a cleaner thereon because a transferred and remaining toner remains on the surface thereof after the secondary transfer. Further, since a large quantity of toners is stuck to the intermediate transfer body or the conveying belt, in the circumstances as stated below, it is necessary to mount a cleaner. That is, 1̂ When the paper jam occurs, a toner image becomes remained on the intermediate transfer body or a toner image erroneously becomes formed on the conveying belt. 2̂ Where image density adjusting is carried out, there is carried out a printing operation for forming a patch image on the intermediate transfer body or the conveying belt.

In the circumstances as stated above, since high cleaning ability is required, a blade cleaning system is employed. The blade cleaning system is the technique widely employed heretofore as a cleaning system for the photosensitive body because that system is high in cleaning ability despite the low expenses.

It is contemplated that in order to improve the cleaning ability and prevent a blade from being burred, a lubricating agent such as zinc stearate, sodium stearate and the like is coated on the intermediate transfer body or the conveying belt. However, the lubricating agent becomes necessary as a consumption article, the running cost of the image forming apparatus increases, a lubricating agent coating mechanism becomes necessary, and the coating mechanism need be replaceable, as a result of which the construction of the image forming apparatus becomes complicated. Further, when a toner image moves into the lubricating agent coating mechanism, the coating mechanism is contaminated by the toner, giving rise to a problem such that the coating ability lowers. Furthermore, in case of the intermediate transfer system, there also occurs a problem that the secondary transfer ability lowers due to the sticking of a lubricating agent depending on material for a secondary transfer roller.

Further, it is contemplated that in case of the intermediate transfer system, the cleaning blade is mounted on not only the intermediate transfer body but also the secondary transfer roller, to plan the longer service life of the secondary transfer roller, and preventing the back of paper from being contaminated. However, since the secondary transfer roller has a high elasticity and is deformed relatively greatly, there also occurs a problem that a cleaning blade for the secondary transfer roller is often burred.

SUMMARY OF THE INVENTION

The present invention has been accomplished in view of problems as noted above with respect to prior art, and has its object to provide an image forming apparatus on which is mounted a cleaning blade for cleaning the surface of an intermediate transfer body or a conveying belt, the apparatus capable of improving cleaning ability and preventing burring of the blade.

It is a further object of the invention to provide an image forming apparatus wherein even if a lubricating agent coating mechanism for coating a lubricating agent on the surface of the intermediate transfer body or the conveying belt is disposed, the lubricating agent coating ability may be maintained sufficiently without increasing the running cost.

It is another object of the invention to provide an image forming apparatus wherein in case of an intermediate transfer system, the longer service life of a secondary transfer roller and the prevention of contamination of the back of paper may be planned.

In the image forming apparatus according to the present invention, for improving the cleaning ability and preventing the blade burring, there is provided a lubricating agent coating mechanism for coating a lubricating agent on the surface of the conveying belt or the intermediate transfer body whereby when detection is made of that a cleaning blade or a conveying belt and an intermediate transfer body are new articles, or when the installation environment of the image forming apparatus is satisfied with the prescribed conditions, the lubricating agent coating mechanism is actuated to coat the lubricating agent on the surface of the conveying belt or the intermediate transfer body.

In order to make it possible to sufficiently maintain the lubricating agent coating ability also without increasing the running cost, measures are taken so that where paper jamming occurs, in the operation of returning the jammed state to a jam-free state, the lubricating agent coating mechanism is operated by a prescribed period of time to coat the lubricating agent in an area where a toner image is not formed on the surface of the conveying belt or the intermediate transfer body.

Further, for planning the longer service life of the secondary transfer roller and the prevention of contamination of the back of paper, measures are taken so that where paper jamming occurs, in the operation of returning the jammed state to a jam-free state, a toner stuck to the secondary transfer roller is transferred in reversed order to the intermediate transfer body.

DETAILED DESCRIPTION OF THE INVENTION

The preferred embodiments of the image forming apparatus to which the present invention is applied will be explained in detail hereinafter with reference to the accompanying drawings.

Embodiment 1

Figure 1:
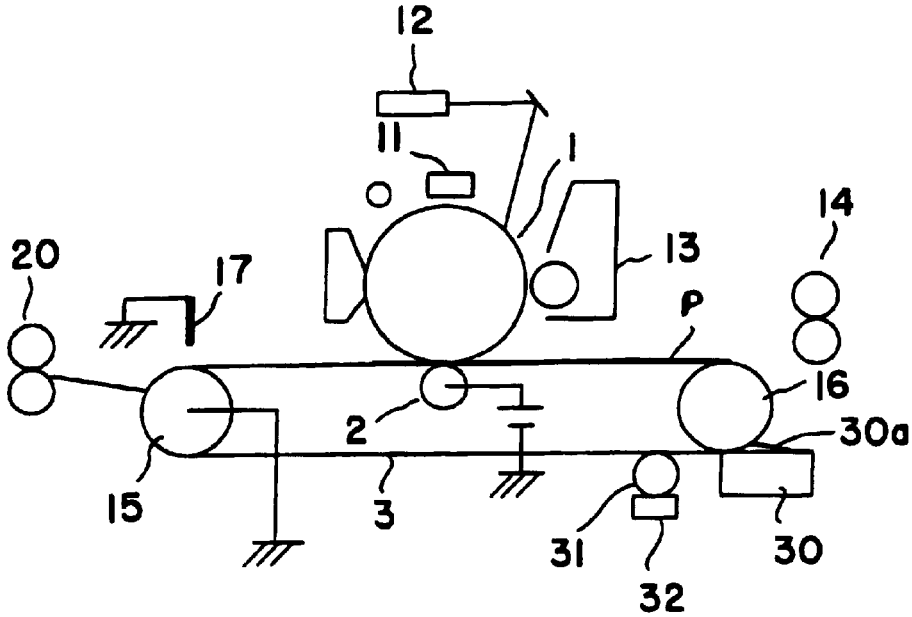
FIG. 1 is a sectional view of a laser printer to which the present invention is applied.

The image forming apparatus applied in the present embodiment is a laser printer as shown in FIG. 1. In this laser printer, printing speed is 30 sheets/minute in lateral feed of A4, and conveying speed is 175 mm/sec.

In FIG. 1, reference numeral 1 designates a photosensitive body drum (organic photoconductive body (OPC) drum of diameter 60 mm) as an image carrier, and the surface of the photosensitive body 1 is uniformly charged to a potential of −500 to −800 V by means of a Scorotron charger 11. Image data is written on the charged photosensitive body 1 by means of a laser scanner 12, and an electrostatic latent image (a charge in an image portion is disappeared) is formed. The electrostatic latent image formed on the photosensitive body 1 is inversion-developed by a 2-component developing unit 13, and a toner image is formed. At that time, the charge polarity of toner is (−) of the same polarity as the polarity at which the photosensitive body 1 is charged.

Paper P is supplied and conveyed from a paper cassette not shown, matched with timing for forming a toner image on the photosensitive body 1, and transported on a conveying belt 3 by an aligning roller 14. The toner image on the photosensitive body 1 is transferred onto the paper P fed to a transfer area by the conveying force of the aligning roller 14 by a transfer electric field formed by transfer roller 2 as a contact charger. Here, a bias voltage of +800 to +2500 V which is a polarity reversal to the charged polarity of toner is applied to a transfer roller 2 by a transfer bias-voltage power source. In the transfer area, a toner image is transferred onto the paper P, and (+) charge is applied to the conveying belt 3 by the transfer roller 2. On the other hand, (−) charge is applied to the paper P due to the discharge between the former and the photosensitive body 1, the paper P is electrostatically adsorbed on the conveying belt 3 by the attraction between the (+) charge and (−) charge, and after passage of the transfer area, the paper P moves together with the conveying belt.

Then, the paper P is separated, in a driving roller 15 for driving the conveying belt 3, from the conveying belt 3, due to the radius of curvature thereof. In the present embodiment, in order to prevent the discharge when the paper P is separated, the driving roller 15 is grounded, and a grounded rejecter brush 17 is disposed upwardly of the driving roller 15. However, in order to separate the paper P more positively, the paper P may be rejected by a corona rejecter making use of AC corona The paper P separated from the conveying belt 3 is conveyed to a fixing unit 20 and subjected to thermal fixing, after which the paper P is discharged outside the apparatus.

The conveying belt 3 is extended between the driving roller 5 and a driven roller 6, a tension spring is connected to both ends of a shaft of the driven roller 6, and tension of 2.1 kgf in total (on both sides) is applied to the conveying belt 3.

A belt cleaner 30 for cleaning the surface of the conveying belt 3 is disposed at a position opposite to a driven roller 16, and a cleaning blade 30*a* is placed in contact with the surface of the conveying belt 3 to thereby effect cleaning.

Figure 2:
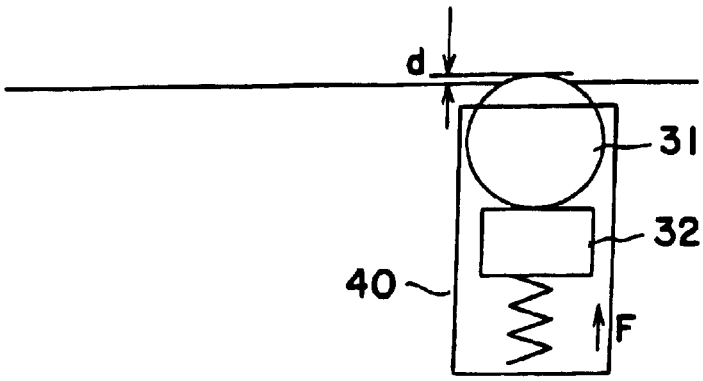
FIG. 2 is a schematic constituent view of a lubricating agent coating mechanism.

A lubricating agent coating brush 31 is arranged upstream of the belt cleaner 30. The lubricating agent coating brush 31 and a lubricating agent 32 are held integrally within a lubricating agent coating unit frame 40 as shown in FIG. 2, and the lubricating agent 32 is pressed against the lubricating agent coating brush 31 with load F whereby the lower end of the lubricating agent coating brush 31 comes in contact with the lubricating agent 32. Here, the load F is a very light load to a degree of 10 to 15 g in total pressure. Further, the lubricating agent coating unit frame 40 is moved up and down whereby the lubricating brush 31 may contact with or separate from the conveying belt 3. The movement of the lubricating agent coating unit frame 40 is carried out by moving a cam, a link, a solenoid or the like, and any of forms such as rotational motion, linear motion and the like may be employed. When the lubricating agent coating brush 31 comes in contact with the conveying belt 3, the bite amount (d) of the lubricating agent coating brush 31 into the surface of the conveying belt 3 is set to be about 0.5 to 1.5 mm. Further, when the lubricating agent coating brush 31 rotates, the lubricating agent 32 is shaved. Therefore, it is controlled so that the lubricating agent coating brush 31 is not rotated except the former comes into contact with the conveying belt 3.

The lubricating agent coating brush 31 is made of fibers such as acryl, rayon and the like which have a fiber diameter of about 2 to 10D. For the lubricating agent 32, there can be used aluminum stearate, zinc stearate, calcium stearate, magnesium stearate, and the like. It is noted that in place of the lubricating agent coating brush 31, there may be used, as a lubricating agent coating member, a sponge roller, a rubber roller and the like.

In the image forming apparatus shown in FIG. 1, when the cleaning bade 30*a* or the conveying belt 3 is exchanged with a new article under the high humidity environments, burring of the cleaning blade 30*a* occurred. In order to cope with this problem, at the time of manufacture, before the cleaning blade 30*a* is mounted, zinc stearate as the lubricating agent 32 is coated on an edge portion of the blade 30*a*, and Kayner (PVDF powder) is coated on the conveying belt 3. However, when a user or a serviceman exchanges the cleaning blade 30*a* or the conveying belt 3 as an article for consumption after selling, the coping measures as mentioned above can not always be taken.

So, in the image forming apparatus in the present embodiment, the lubricating agent coating mechanism as described above is disposed in order to prevent the cleaning blade 30*a* from burring, and the lubricating agent coating operation is executed automatically. It is contemplated that as the method for judging whether the cleaning blade 30*a* and the conveying belt 3 are new articles, the following methods are employed.

A. A user or a serviceman exchanges the cleaning blade 30*a*, the conveying belt 3 or both of them, such a fact is input from a display panel of the image forming apparatus.

B. The image forming apparatus counts the number of prints, and gives a warning that the cleaning blade 30*a* or the conveying belt 3 is at an end (of a life). Then, where detection is made, by a replacement detecting device of a conveying belt unit, of the fact that the conveying belt 3 was replaced, judgment is automatically made of the fact that the cleaning blade 30*a*, the conveying belt 3 or both of them was replaced.

Where judgment is made of the fact that the image forming apparatus exchanges the cleaning blade 30*a*, the conveying belt 3 or both of them by the methods as described above, the lubricating agent coating operation is automatically executed in the following procedure.

① The lubricating agent coating brush 31 is placed in contact with the conveying belt 3, and the conveying belt 3 is driven at speed lower than that used normally.

② The operation of ① is continued for a prescribed period of time.

③ The driving speed of the conveying belt 3 is returned to the normal process speed, and the normal initialization operation starts.

For studying the driving speed of the conveying belt 3 at the time of the lubricating agent coating operation, the driving speed of the conveying belt 3 is changed from 20 mm/sec to 175 mm/sec which is normal process speed in the lubricating agent coating operation, to investigate the occurring state of the blade burring. Such a test as described above was conducted under the three environments, temperature 10° C. humidity 20%, temperature 23° C. humidity 50%, and temperature 30° C. humidity 85%. The result is shown in Table 1.

TABLE 1

| | 10° C. 20% | 23° C. 50% | 30° C. 85% |
|---|---|---|---|
| 175 (mm/sec) | ○ | ○ | X |
| 160 | ○ | ○ | X |
| 120 | ○ | ○ | X |
| 100 | ○ | ○ | ○ |
| 75 | ○ | ○ | ○ |
| 55 | ○ | ○ | ○ |
| 30 | ○ | ○ | ○ |
| 20 | ○ | ○ | ○ |
| 15 | Δ | ○ | ○ |

○: Good Δ: Chattering occurs X: Burring occurs

As will be understood from TABLE 1, under the normal temperature and normal humidity environments (23° C. 50%), even at the normal process speed, no problem occurs, but under the high temperature and much humidity environments (30° C. 85%), the blade burring tends to occur rapidly. It was found that in order not to produce the blade burring under all the environments, the driving speed of the conveying belt 3 need be set to less than 100 mm/sec. On the other hand, when the driving speed is too slow, chattering noises occurred under the low temperature and low humidity environments (10° C. 20%). It was found from the foregoing results that the driving speed of the conveying belt 3 at the lubricating agent coating operation is preferable to be 20 to 100 mm/sec.

For studying the lubricating agent coating time at the lubricating agent coating operation, the driving speed of the conveying belt 3 was set to 78.5 mm/sec (½ of that at normal time), and the lubricating agent coating time was changed at intervals of 0.5 sec to investigate the occurrence state of the blade burring. The result is shown in TABLE 2.

TABLE 2

| Coating time (sec) | Blade burring |
|---|---|
| 0.5 | X |
| 1 | X |
| 1.5 | X |
| 2 | ○ |
| 2.5 | ○ |
| 3 | ○ |
| 3.5 | ○ |
| 4 | ○ |
| 4.5 | ○ |
| 5 | ○ |
| 5.5 | ○ |
| 6 | ○ |

○: No blade burring occurs X: Blade burring occurs

As will be understood from TABLE 2, if the lubricating agent 32 is coated for two seconds or more at the lubricating agent coating operation, no blade burring occurs. Since the circumferential length of the conveying belt 3 used in the present embodiment is about 471 mm (outside diameter: 150 mm), it takes about 6 seconds to coat the lubricating agent 32 on the whole outer circumferential surface of the conveying belt 3. However, the lubricating agent 32 is not necessary coated on the whole outer circumferential surface of the conveying belt 3, but if some quantity of the lubricating agent 32 is supplied to the contact portion between the cleaning blade 30*a* and the conveying belt 3, the lubricating agent 32 can be coated on the conveying belt 3 while being extended by the cleaning blade 30*a*, because of which the blade burring would not occur. In the present embodiment, finally, the driving speed of the conveying belt 3 at the time of lubricating-agent coating operation was set to 78.5 mm/sec, and the lubricating agent coating time was set to 3 seconds. By setting them to the conditions as described, even under the high temperature and much humidity environments of 30° C. 85%, even both the conveying belt 3 and the cleaning blade 30*a* are exchanged with new articles simultaneously, no blade burring occurred.

Embodiment 2

Figure 3:
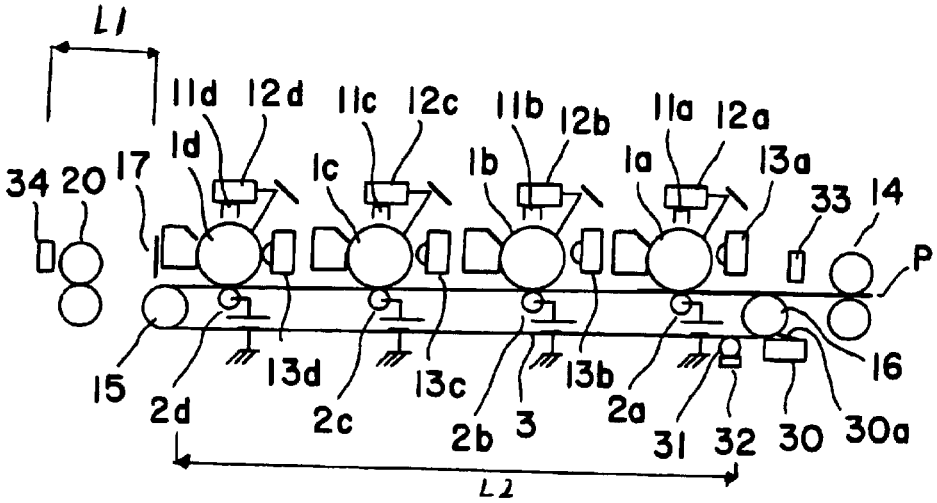
FIG. 3 is a sectional view of one embodiment of a quadruple tandem system color printer to which the present invention is applied.

The image forming apparatus applied in the present embodiment is a quadruple tandem system color printer as shown in FIG. 3. In this color printer, printing speed is 30 sheets/minute in lateral feed of A4 (both color and monochrome), and process speed is 175 mm/sec.

In FIG. 3, reference numeral 1*a* to 1*d* designate a photosensitive body drum (organic photoconductive body (OPC) drum of diameter 30 mm) as an image carrier, and the surfaces of the photosensitive bodies 1*a* to 1*d* are uniformly charged to a potential of −500 to −800 V by means of Scorotron chargers 11*a* to 11*d*. Image data is written on the charged photosensitive bodies 1*a* to 1*d* by means of laser scanners 12*a* to 12*d*, and an electrostatic latent image is formed. The electrostatic latent images formed on the photosensitive bodies 1*a* to 1*d* are inversion-developed by 2-component developing units 13*a* to 13*d* (a: yellow, b: magenta, c: cyan, d: black), and a toner image is formed. At that time, the charge polarity of toner is (−) of the same polarity as the polarity at which the photosensitive bodies 1*a* to 1*d* are charged.

Paper P is transported on a conveying belt 3 by an aligning roller 14 while being matched with timing for forming a toner image on the photosensitive bodies 1*a* to 1*d*. The toner images on the photosensitive bodies 1*a* to 1*d* are transferred onto the paper P fed to a transfer area by the conveying force of the aligning roller 14 by a transfer electric field formed by transfer rollers 2*a* to 2*d* as a contact charger. Here, a bias voltage of +800 to +4000 V which is a polarity reversal to the charged polarity of toner is applied to the transfer rollers 2*a* to 2*d* by transfer bias-voltage power sources 19*a* to 19*d*. In the transfer area, a toner image is transferred onto the paper P, and (+) charge is applied to the conveying belt 3 by the transfer rollers 2*a* to 2*d*. On the other hand, (−) charge is applied to the paper P due to the discharge between the former and the photosensitive bodies 1*a* to 1*d*, the paper P is electrostatically adsorbed on the conveying belt 3 by the attraction between the (+) charge and the (−) charge, and after passage of the transfer area, the paper P moves together with the conveying belt 3.

Then, the paper P is separated, in a driving roller 15 for driving the conveying belt 3, from the conveying belt 3, due to the radius of curvature thereof. In the present embodiment, the driving roller 15 is grounded, and a rejecter brush 17 is disposed, similarly to Embodiment 1. The paper P separated from the conveying belt 3 is conveyed to a fixing unit 20 and subjected to thermal fixing, after which the paper P is discharged outside the apparatus.

A belt cleaner 30 for cleaning the surface of the conveying belt 3 is disposed at a position opposite to a driven roller 16, and a cleaning blade 30*a* is placed in contact with the surface of the conveying belt 3 to thereby effect cleaning. A lubricating agent coating brush 31 is arranged upstream of the belt cleaner 30.

The constitution and material of the lubricating agent coating brush 31 and the lubricating agent 32, the constitution of the lubricating agent coating unit frame 40 and the like are similar to those described in Embodiment 1.

Since the image forming apparatus in the present embodiment is a color printer, toner images of four colors are stuck onto the conveying belt 3 when the paper jam occurs, and a considerably high cleaning ability is required to clean it. Therefore, the contact of the cleaning blade 30*a* with the conveying belt 3 is unavoidably set to the state close to that comes in contact at the edge portion as compared with the monochrome image forming apparatus as in Embodiment 1. Further, polyimide resin which is a material for the cleaning blade 30*a* is higher in surface energy than fluorine resin, and therefore, as compared with the image forming apparatus of Embodiment 1, the blade burring tends to occur, and as shown in TABLE 3, even if the cleaning blade 30*a* and the conveying belt 3 are not new articles, the blade burring occurs under the high-temperature much-humidity environments.

TABLE 3

| Blade | Conveying belt | 10° C. 20% | 23° C. 50% | 30° C. 85% |
|---|---|---|---|---|
| New article | New article | ○ | X | X |
| 10000 used | New article | ○ | ○ | X |
| New article | 10000 used | ○ | ○ | X |
| 10000 used | 10000 used | ○ | ○ | X |

○: No blade burring occurs X: Blade burring occurs

Thus, in the image forming apparatus in Embodiment 2, the lubricating agent coating operation automatically executed by detecting the environments where the image forming apparatus is installed not depending on whether the cleaning blade 30*a* and the conveying belt 3 are new articles. TABLE 4 shows the occurrence circumstances of the blade burring with respect to the installation environments in case where a new cleaning blade 30*a* and a new conveying belt 3 were used.

TABLE 4

| Temp. (° C.) Humidity (% RH) | 10 | 15 | 20 | 25 | 30 |
|---|---|---|---|---|---|
| 10 | ○ | ○ | ○ | ○ | ○ |
| 20 | ○ | ○ | ○ | ○ | ○ |
| 30 | ○ | ○ | ○ | ○ | ○ |
| 40 | ○ | ○ | ○ | X | X |
| 50 | ○ | ○ | X | X | X |
| 60 | ○ | X | X | X | X |
| 70 | ○ | X | X | X | X |
| 80 | X | X | X | X | X |
| 90 | X | X | X | X | X |

○: No blade burring occurs X: Blade burring occurs

In the image forming apparatus in the present embodiment, a temperature- and humidity sensor is disposed to control a transfer bias voltage, and in case of indicating that an output of the temperature- and humidity sensor is the environmental condition indicated by x in TABLE 4, the lubricating agent coating operation is automatically executed before starting the printing operation. Preferably, the driving speed of the conveying belt 3 at the time of lubricating agent coating operation is set within the range shown in TABLE 1, similar to Example 1. However, in Embodiment 2, the peripheral length of the conveying belt 3 is longer, and also in terms of material for the conveying belt 3, the blade burring tends to occur, because of which the coating time of a lubricating agent is different from that of Embodiment 1, as shown in TABLE 5. Therefore, in the present embodiment, the driving speed of the conveying belt 3 at the time of lubricating agent coating operation is set to 87 mm/sec, and the lubricating agent coating time is set to 4 sec.

TABLE 5

| Coating time (sec) | Blade burring |
|---|---|
| 0.5 | X |
| 1 | X |
| 1.5 | X |
| 2 | X |
| 2.5 | X |
| 3 | ○ |
| 3.5 | ○ |
| 4 | ○ |
| 4.5 | ○ |
| 5 | ○ |
| 5.5 | ○ |
| 6 | ○ |

○: No blade burring occurs X: Blade burring occurs

Figure 4:
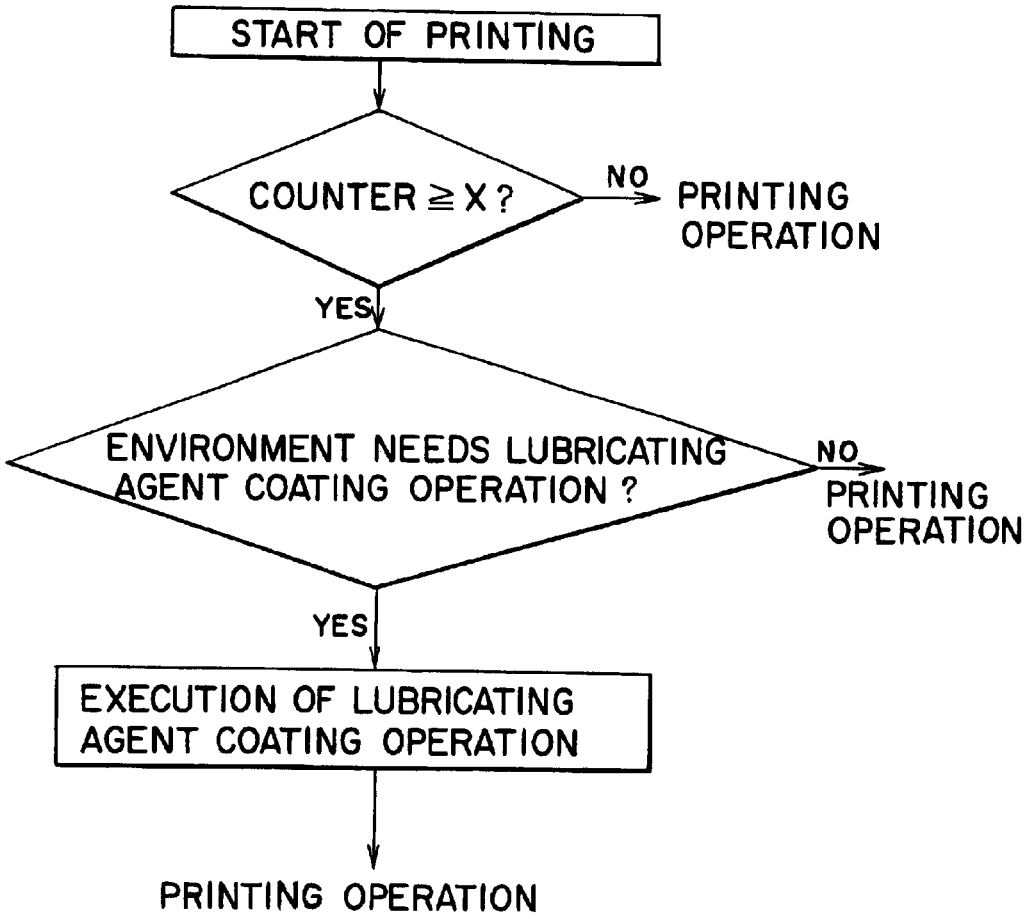
FIG. 4 is a flowchart for judging whether the lubricating agent coating operation is conducted.
Figure 5:
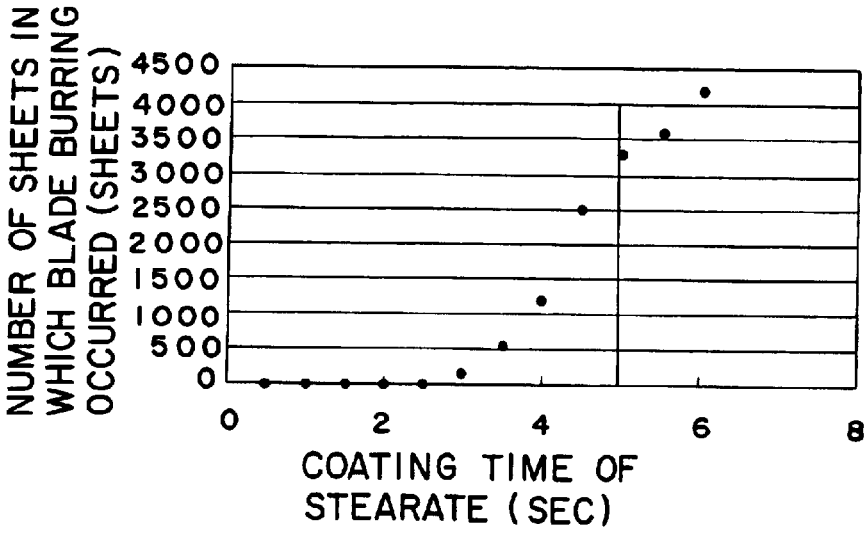
FIG. 5 is a graph showing that where printing is conducted under the high-temperature high-humidity environments after the lubricating agent coating operation, the number of sheets in which burring of blade occurred is investigated by changing the lubricating agent coating time.

However, if the lubricating agent coating operation is executed every time the printing operation star, the lubricating agent 32 is severely consumed, resulting in frequent exchange of a lubricating agent coating unit. Further, since wasteful time of 4 seconds occurs every time till printing on the first paper P starts, the time for printing on the first paper P becomes very slow. So, in the present embodiment, the lubricating agent coating operation is not executed every time the printing operation starts under the above-described environments but the prescribed number of sheets is printed after the previous lubricating agent coating operation has been executed, after which the lubricating agent coating operation is executed. Therefore, the image forming apparatus in the present embodiment has a counter for the number of printing sheets to which is reset the number of printing sheets every time the lubricating agent coating operation is executed. FIG. 4 is a flowchart for judging whether the lubricating agent coating operation is carried out. FIG. 5 shows the result obtained from that the number of sheets in which the blade burring occurred where printing was carried out under the high temperature and high humidity environments after the lubricating agent coating operation is tested by changing the lubricating agent coating time. It is understood referring to FIG. 5 that if the lubricating agent coating time is extended, the number of printing sheets till the subsequent lubricating agent coating operation starts can be set to many sheets. In the present embodiment, there is shown that the output of the temperature- and humidity sensor is the environmental condition indicated by x in TABLE 4, and where the counter value of a counter for the number of printing sheets exceeds 2000 sheets, the lubricating agent coating operation for 5 seconds is executed. By executing such a lubricating agent coating operation as described, the burring of the cleaning blade 30*a* does not occur, and cleaning of the conveying belt 3 can be accomplished well.

While in the present embodiment, the lubricating agent coating operation is controlled by the temperature- and humidity sensor for detecting the environments within the image forming apparatus which is used to control the transfer bias voltage, it is noted that an output signal of a temperature- and humidity sensor mounted on an air conditioner installed within a room is received through a network, and controlling of the lubricating agent coating operation may be also carried out in response to the output signal.

Embodiment 3

Figure 6:
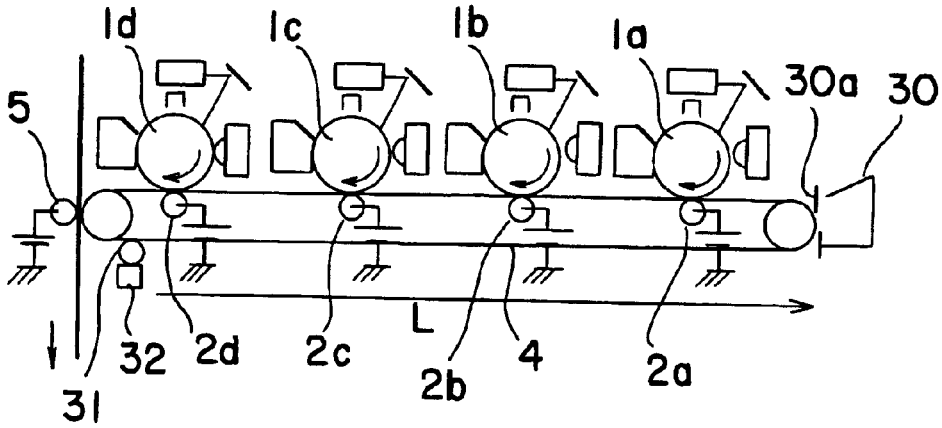
FIG. 6 is a sectional view of one embodiment of a quadruple tandem system color printer employing an intermediate transfer belt to which the present invention is applied.

The image forming apparatus applied in the present embodiment is a quadruple tandem system color printer employing an intermediate transfer belt as shown in FIG. 6. In this color printer, printing speed is 30 sheets/minute in lateral feed of A4 (both color and monochrome), and process speed is 175 mm/sec.

The step for forming toner images on the photosensitive bodies 1*a* to 1*d* is similar to that in Embodiment 2.

In the image forming apparatus according to the present embodiment, toner images of respective colors formed on the photosensitive bodies 1*a* to 1*d* are transferred to an intermediate transfer belt 4 by transfer rollers 2*a* to 2*d* to form color images on the intermediate transfer belt 5. In the state that the paper P is held between the intermediate transfer belt 4 and the secondary transfer roller 5, a bias voltage of polarity reversal to the toner is applied to the secondary transfer roller 5 whereby the color image formed on the intermediate transfer belt 4 is transferred to the paper P to form a color image on the paper P.

Then, the paper P is conveyed to a fixing unit not shown and subjected to thermal fixing, after which the paper is discharged outside the apparatus.

The belt cleaner 30 for cleaning the surface of the intermediate transfer belt 4 is disposed at a position opposite to the driven roller 16, and the cleaning blade 30*a* is placed in contact with the surface of the intermediate transfer belt to thereby clean a toner remained in the secondary transfer. Further, the lubricating agent coating brush 31 is arranged upstream of the belt cleaner 30.

The constitution and material of the lubricating agent coating brush 31 and the lubricating agent 32, the constitution of the lubricating agent coating unit frame 40, and the like are similar to those described in Embodiment 1.

Also in the image forming apparatus in the present embodiment, the lubricating agent coating mechanism is disposed to prevent the cleaning blade 30*a* from burring, and the lubricating agent coating operation is executed automatically. As a method for judging whether the cleaning blade 30*a* and the intermediate transfer belt 4 are new articles, the method similar to that of Embodiment 1 can be employed.

Where the image forming apparatus judges, by the method as described above, that the cleaning blade 30*a*, the intermediate transfer belt 4 or both of them were exchanged, the lubricating agent coating operation is executed automatically by the following procedure.

1̂ The cleaning blade 30*a* is separated from the intermediate transfer belt 4, and the intermediate transfer belt 4 is driven.

2̂ The lubricating agent coating brush 31 is placed in contact with the intermediate transfer belt 4, and the lubricating agent 32 is coated on the intermediate transfer belt 4.

3̂ When the portion of the intermediate transfer belt 4 where the lubricating agent is coated arrives at the cleaning blade 30*a* portion, the cleaning blade 30*a* is placed in contact with the intermediate transfer belt 4.

4̂ The normal initialization operation starts.

Unlike the image forming apparatus of Embodiment 1, in the image forming apparatus of the intermediate transfer system, the intermediate transfer body cleaner 30 has an approach- and part mechanism so as to enable preventing the contact between the lubricating agent uncoated portion of the intermediate transfer belt 4 and the cleaning blade 30*a*, and therefore, it is not necessary to make the speed of the intermediate transfer belt 4 slower than the normal speed. Further, since the intermediate transfer belt 4 is a resin belt of a Teflon base (PVDF), belt burring is hard to occur as compared with a resin belt of a polyimide base as in Embodiment 2.

However, under the high-temperature much-humidity environments, burring of the cleaning blade 30*a* also occurred. TABLE 6 shows the blade-burring occurrence circumstances with respect to the time from the start of coating the lubricating agent 32 on the intermediate transfer belt 4 to the placement of the cleaning blade 30*a* in contact. The lubricating agent 32 has been continuously coated for about 5 seconds.

TABLE 6

| T | 10° C. 20% | 23° C. 50% | 30° C. 85% |
|---|---|---|---|
| 0 | ○ | ○ | X |
| 0.5 | ○ | ○ | X |
| 1 | ○ | ○ | X |
| 1.5 | ○ | ○ | X |
| 2 | ○ | ○ | ○ |
| 2.5 | ○ | ○ | ○ |
| 3 | ○ | ○ | ○ |

T: Time from lubricating agent-coating to blade-contact

As will be understood from TABLE 6, the time from the start of coating the lubricating agent 32 on the intermediate transfer belt 4 to the placement of the cleaning blade 30*a* in contact need be set to two seconds or more. Since the distance L from the lubricating agent coating brush 31 to the cleaning blade 30*a* is 300 mm, the time till the lubricating agent coating portion of the intermediate transfer body belt 4 arrives at the cleaning blade 30*a* is 300 mm÷175 mm/sec= 1.7 sec. The result given in TABLE 6 shows that unless the cleaning blade 30*a* does not come in contact with the lubricating agent coating portion, the blade burring occurs.

On the other hand, TABLE 7 shows the blade-burring occurrence circumferences where the time from the start of coating the lubricating agent 32 on the intermediate transfer belt 4 to the placement of the cleaning blade 30*a* in contact is set to two seconds, and the lubricating agent coating time is changed.

TABLE 7

| t | 10° C. 20% | 23° C. 50% | 30° C. 85% |
|---|---|---|---|
| 0 | ○ | ○ | X |
| 0.5 | ○ | ○ | X |
| 1 | ○ | ○ | X |
| 1.5 | ○ | ○ | X |
| 2 | ○ | ○ | X |
| 2.5 | ○ | ○ | X |
| 3 | ○ | ○ | X |
| 3.5 | ○ | ○ | ○ |
| 4 | ○ | ○ | ○ |
| 4.5 | ○ | ○ | ○ |
| 5 | ○ | ○ | ○ |

t: Lubricating agent coating-time

The time required for the intermediate transfer belt 4 to run around is 254×3.14156÷175=4.56 sec. However, as will be understood from TABLE 7, if the lubricating agent coating time is 3.5 sec, no blade burring occurs, and even if the lubricating agent 32 is not coated on the whole peripheral length of the intermediate transfer belt 4, the blade burring does not occur. Since the lubricating agent coating time is 3.5 sec, the cleaning blade 30*a* is in contact with the lubricating agent coating portion of the intermediate transfer belt 4 for 1.5 sec after the contact of the cleaning blade 30*a*, but thereafter, it is in contact with the lubricating agent uncoated portion. The reason why the blade burring does not occur despite the above-described fact is contemplated such that the lubricating agent 32 in the quantity for 1.5 sec (262 mm in length) is accumulated between the cleaning blade 30*a* and the intermediate transfer belt 4, and the lubricating agent 32 is extended even to the lubricating agent uncoated portion of the intermediate transfer belt 4.

From the foregoing, in the present embodiment, the lubricating agent coating time is set to 4 seconds, and the time from the start of coating the lubricating agent 32 on the intermediate transfer belt 4 to the placement of the cleaning blade 30*a* in contact is set to 2 seconds, to execute the lubricating agent coating operation. As a result even if the intermediate transfer belt 4 and the cleaning belt 30*a* are exchanged with new articles under the high-temperature much-humidity environments, burring of the cleaning blade 30*a* did not occur.

The technique in the present embodiment is not limited to the quadruple tandem system image forming apparatus employing the intermediate transfer belt 4, but can be applied also to a 4-rotation system image forming apparatus employing an intermediate transfer belt, and further an intermediate transfer drum.

Embodiment 4

The image forming apparatus applied in the present embodiment is a quadruple tandem system color printer employing an intermediate transfer belt as shown in FIG. 6, the constitution of apparatus is similar to the color printer in Embodiment 3, and the basic printing operation is also similar thereto.

As the intermediate transfer belt 4, there can be used one which is made of material, has a thickness and resistance similar to those described in Embodiment 3. However, in the present embodiment, there is used a polyimide belt having a volume resistance value: $10_9$ Ω·cm and a thickness: 125 μm in consideration of mechanically long service life.

The arrangement of the belt cleaner 30 and the lubricating agent coating brush 31, the constitution and material of the lubricating agent coating brush 31 and the lubricating agent 32, and the constitution of the lubricating agent coating unit frame 40, and the like are also similar to those described in Embodiment 3.

The polyimide resin which is a material for the intermediate transfer belt 4 in the present embodiment is higher in surface energy than PVDF which is a fluorine resin. Therefore, in the image forming apparatus in the present embodiment, burring of the cleaning blade 30*a* tends to occur as compared with the image forming apparatus of Embodiment 3. As shown in TABLE 8, even if the cleaning blade 30*a* and the intermediate transfer belt 4 are not new articles, the blade burring occurs under the high-temperature much-humidity environments, and if the cleaning blade 30*a* and the intermediate transfer belt 4 are new articles, the blade burring occurs even under the normal-temperature normal-humidity environments.

TABLE 8

| Cleaning blade | Intermediate transfer belt | 10° C. 20% | 23° C. 50% | 30° C. 85% |
|---|---|---|---|---|
| New article | New article | ○ | X | X |
| 10000 used | New article | ○ | ○ | X |
| New article | 10000 used | ○ | ○ | X |
| 10000 used | 10000 used | ○ | ○ | X |

○: No blade burring occurs X: Blade burring occurs

Thus, in the present embodiment, despite whether the cleaning blade 30*a* and the intermediate transfer belt 4 are new articles, the installation environments of the image forming apparatus is detected, and the lubricating agent coating operation is automatically executed.

In the image forming apparatus in the present embodiment, a temperature-humidity sensor is disposed to control a transfer bias voltage, and therefore, the lubricating agent coating operation is automatically executed by an output of the temperature- and humidity sensor. TABLE 9 shows the occurrence circumstances of blade burring with respect to the installation environments where a new cleaning blade 30*a* and an intermediate belt 4 are used.

TABLE 9

| Cleaning blade • Intermediate transfer belt • New article | | | | | |
|---|---|---|---|---|---|
| Temp (° C.) Humidity (%) | 10 | 15 | 20 | 25 | 30 |
| 10 | ○ | ○ | ○ | ○ | ○ |
| 20 | ○ | ○ | ○ | ○ | ○ |
| 30 | ○ | ○ | ○ | ○ | ○ |
| 40 | ○ | ○ | ○ | X | X |
| 50 | ○ | ○ | X | X | X |
| 60 | ○ | X | X | X | X |
| 70 | ○ | X | X | X | X |
| 80 | X | X | X | X | X |
| 90 | X | X | X | X | X |

○: No blade burring occurs X: Blade burring occurs

As will be understood from TABLE 9, the blade burring occurs from the normal-temperature normal-humidity environments to the high-temperature high-humidity environments. It is therefore contemplated such that in case of the environments of x in TABLE 9, the lubricating agent coating operation is executed. However, if doing so, even under the normal-temperature normal-humidity environments, the lubricating agent coating operation has to be executed every time the printing operation starts consuming quantity of the lubricating agent 32 increases so that the lubricating agent coating unit has to be exchanged frequently.

TABLE 11 show the occurrence circumstances of blade burring with respect to the installation environments where the cleaning blade 30*a* and the intermediate transfer belt 4 are used after use of 10000 and 100000 sheets.

TABLE 10

Cleaning blade • Intermediate transfer belt • 10000 used

| Temp. (° C.) Humidity (%) | 10 | 15 | 20 | 25 | 30 |
|---|---|---|---|---|---|
| 10 | ○ | ○ | ○ | ○ | ○ |
| 20 | ○ | ○ | ○ | ○ | ○ |
| 30 | ○ | ○ | ○ | ○ | ○ |
| 40 | ○ | ○ | ○ | ○ | ○ |
| 50 | ○ | ○ | ○ | ○ | ○ |
| 60 | ○ | ○ | ○ | ○ | ○ |
| 70 | ○ | ○ | ○ | X | X |
| 80 | ○ | X | X | X | X |
| 90 | X | X | X | X | X |

○: No blade burring occurs X: Blade burring occurs

TABLE 11

Cleaning blade • Intermediate transfer belt • 100000 used

| Temp. (° C.) Humidity (%) | 10 | 15 | 20 | 25 | 30 |
|---|---|---|---|---|---|
| 10 | ○ | ○ | ○ | ○ | ○ |
| 20 | ○ | ○ | ○ | ○ | ○ |
| 30 | ○ | ○ | ○ | ○ | ○ |
| 40 | ○ | ○ | ○ | ○ | ○ |
| 50 | ○ | ○ | ○ | ○ | ○ |
| 60 | ○ | ○ | ○ | ○ | ○ |
| 70 | ○ | ○ | ○ | ○ | X |
| 80 | ○ | ○ | X | X | X |
| 90 | X | X | X | X | X |

○: No blade burring occurs X: Blade burring occurs

Comparing TABLES 9, 10 and 11, it is understood that in case of the cleaning blade 30*a* and the intermediate transfer belt 4 after use of 10000 sheets, the environmental area in which the blade burring occurs becomes considerably narrowed, and in case of the cleaning blade 30*a* and the intermediate transfer belt 4 after use of 10000 sheets and after use of 100000 sheets, there is not much difference in the environments in which the blade burring occurs. In the present embodiment, where both the cleaning blade 30*a* and the intermediate transfer belt 4 are new articles, the lubricating agent coating operation is executed in the environmental area of x in TABLE 9, but where either one of the cleaning blade 30*a* and the intermediate transfer belt 4 is not a new article (after use of 10000 sheets or more), the lubricating agent coating operation is executed only in the environmental TABLE 10.

As described above, in the present embodiment, judgment was made whether the lubricating agent coating operation is carried out in consideration of the installation environments of the image forming apparatus, and new or old of the cleaning blade 30*a* and the intermediate transfer belt 4, whereby the burring of the cleaning blade 30*a* was not occurred, and moreover, the consuming quantity of the lubricating agent 32 could be reduced considerably.

Embodiment 5

The image forming apparatus applied in the present embodiment is a quadruple tandem system color printer as shown in FIG. 3. The constitution of apparatus is similar to the color printer in Embodiment 2, and the basic printing operation is also similar thereto. Further, the material and properties of the conveying belt 3, and the material and properties of the transfer roller 2 are also similar to those of Embodiment 2.

In the image forming apparatus as described above, when the paper jam occurs, a toner image is erroneously formed on the conveying belt 3, and when the toner image moves into the belt cleaner 30, the cleaning blade 30*a* runs on the toner, resulting in occurrence of poor cleaning.

In the image forming apparatus shown in FIG. 3, the lubricating agent coating brush 31 is placed in a state that the former is separated from the conveying belt 3, and a monochrome or a three-color over toner image is formed on the conveying belt 3 without conveying the paper P to investigate whether the toner image is cleaned by the belt cleaner 30. The result is as shown in TABLE 12.

TABLE 12

| Print rate | Single color | 3-Color over |
|---|---|---|
| 10 | ○ | ○ |
| 20 | ○ | ○ |
| 30 | ○ | ○ |
| 40 | ○ | ○ |
| 50 | ○ | ○ |
| 60 | ○ | X |
| 70 | ○ | X |
| 80 | ○ | X |
| 90 | ○ | X |
| 100 | ○ | X |

○: No poor-cleaning occurs X: Poor-cleaning occurs

As will be understood from TABLE 12, when the printing rate of respective colors exceeds 50%, poor cleaning occurs, that is, where printing is carried out after occurrence of the paper jam, the contamination of the back of paper is to occur.

Next, TABLE 13 shows the result in which the lubricating agent 32 is coated in advance on the surface of the conveying belt 3, and the experiment similar to that mentioned above was carried out.

TABLE 13

| Print rate | Single color | 3-Color over |
|---|---|---|
| 10 | ○ | ○ |
| 20 | ○ | ○ |
| 30 | ○ | ○ |
| 40 | ○ | ○ |
| 50 | ○ | ○ |
| 60 | ○ | ○ |
| 70 | ○ | ○ |
| 80 | ○ | ○ |
| 90 | ○ | ○ |
| 100 | ○ | ○ |

○:No poor-cleaning occurs X: Poor-cleaning occurs

As will be understood from TABLE 13, the lubricating agent 32 is coated to thereby improve the release properties between the toner and the conveying belt 3. Even if a 3-color over whole solid image (printing rate: 100%) is formed, no poor cleaning occurs. Therefore, it is understood that the coating of the lubricating agent 32 not only exhibits the effect for prevention of burring of the cleaning blade 30*a*, but also exhibits the effect for improvement of the cleaning ability of the conveying belt 3.

TABLE 14 shows the result as to the occurrence circumstances of poor cleaning with respect to a monochrome halftone image of printing rate 50% and a 3-color over halftone image were investigated every number of uses of the conveying belt 3 and the cleaning blades 30*a*. Further, the results were compared between the case where printing is continued without totally coating the lubricating agent 32 on the conveying belt 3 and the case where printing is continued without coating the lubricating agent 32, and the lubricating agent 32 is coated immediately before conducting cleaning experiments.

TABLE 14

| Number of print | Lubricating agent not coated | | Lubricating agent coated | |
|---|---|---|---|---|
| (1000) | Single color | 3-color over | Single color | 3-color over |
| 0 | ○ | ○ | ○ | ○ |
| 10 | ○ | ○ | ○ | ○ |
| 50 | ○ | X | ○ | ○ |
| 100 | ○ | X | ○ | ○ |
| 200 | X | X | ○ | ○ |

○: No poor-cleaning occurs X: Poor-cleaning occurs

It is understood from TABLE 14 that when printing is continued, the cleaning blade 30*a* becomes worn, because of which the cleaning performance lowers, but when the lubricating agent 32 is coated, the adhesive force between the toner and the conveying belt 3 lowers, because of which even if the cleaning blade 30*a* after printing of 200,000 sheets is used, cleaning can be conducted well. Therefore, as shown in FIG. 3, there is employed the constitution in which the lubricating agent coating brush 31 and the lubricating agent 32 are disposed to coat the lubricating agent 32 on the conveying belt 3.

However, in the constitution shown in FIG. 3, when the belt cleaner 30 is arranged at a position opposite the driving roller 15, and the lubricating agent coating brush 31 is arranged downstream of the cleaning blade 30*a*, then when the paper jam occurs, the lubricating agent 32 is to be coated behind the toner image transferred onto the conveying belt 3 so as not to avoid poor cleaning. On the other hand, when the lubricating agent coating brush 31 is arranged upstream of the cleaning blade 30*a*, if the lubricating agent coating brush 31 is always placed in contact with the conveying belt 3, the lubricating agent coating brush 31 is contaminated by toner to lower the lubricating agent coating effect, bringing forth the blade burring or poor cleaning. So, the lubricating agent coating brush 31 is made so as to approach and part from the conveying belt 3, and it is controlled so that only when the lubricating agent coating operation is executed, the brush comes in contact with the conveying belt 3.

In the image forming apparatus in the present embodiment, the circumferences in which the paper jam occurs are studied as follows:

① Jam in which the extreme end of paper P does not arrive at the paper detection sensor 33 portion A yellow (Y) image is merely formed on the photosensitive body 1*a*, and a toner image is not formed on the conveying belt 3. Therefore, poor cleaning is out of problem.

Figure 7:
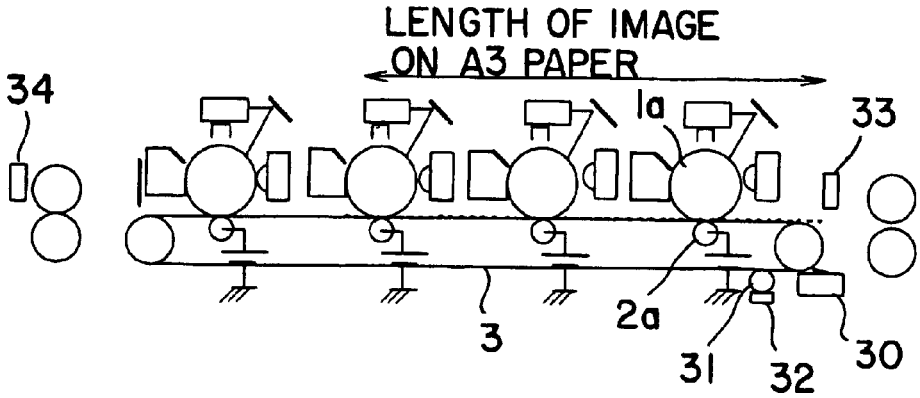
FIGS. 7, 8 and 9 are respectively explanatory views where the paper jamming occurs in a quadruple tandem system color printer.

② Jam in which the extreme end of paper P has passed the paper detection sensor 33, but the rear end thereof has not passed. Where the paper jam occurs before the extreme end of paper P does not arrive the transfer roller 2*a*, a toner image is formed on the conveying belt 3 over the area from the paper detection sensor 33 portion (length of paper P +α), after which the image forming apparatus stops. FIG. 7 shows the circumstances where jam occurs when printing is done on A3 paper. A yellow (Y) image is formed on substantially the whole area of A3 paper size on the conveying belt 3, and magenta (M) and cyan (C) images are formed on a partial area, and a portion of a 3-color over image exists. Therefore, in the state that the lubricating agent 32 is not coated on the conveying belt 3, when the toner image moves into the cleaning blade 30*a*, poor cleaning occurs.

Figure 8:
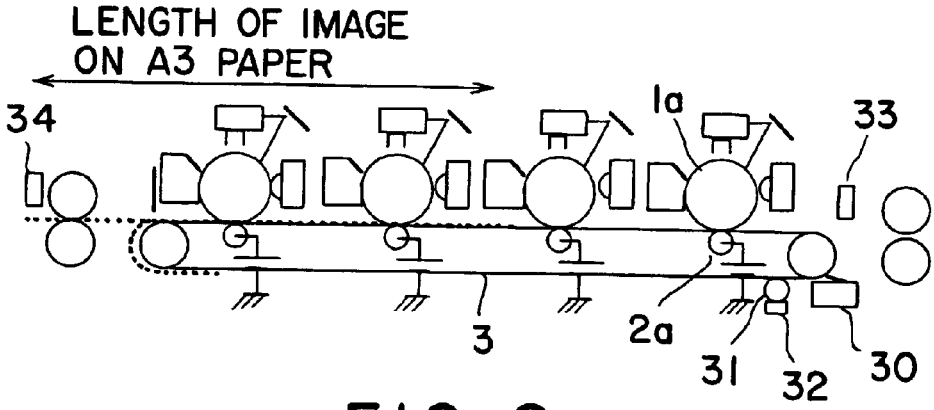
Figure 9:
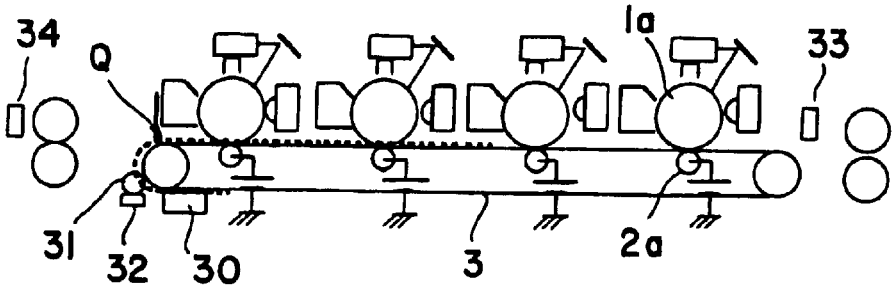

③ Jam in which the rear end of paper P has passed the paper detection sensor 33 but the extreme end thereof has not arrive at the paper detection sensor 34.

Where paper P is caught in somewhere before the extreme end of paper P is held by the transfer roller 2*a*, and the zigzag paper jam occurs, in the worst case, a 3-color over image becomes transferred to the conveying belt 3 completely, as shown in FIG. 8. Therefore, when in the state that the lubricating agent 32 is not coated on the conveying belt 3, the toner image moves into the cleaning blade 30*a*, poor cleaning occurs. Further, when the belt cleaner 30 and the lubricating agent coating brush 31 are arranged at a position as shown in FIG. 9, when the image forming apparatus stops due to the paper jam, the toner image already formed on the conveying belt 3 has passed the cleaning blade 30*a* portion, and the blade 30*a* runs on the toner image, resulting in the occurrence of poor cleaning.

From the foregoing, distance L1 from a position Q at which paper P is separated from the conveying belt 3 to the paper detection sensor 34 portion and distance L2 from the separated position Q to the lubricating agent coating brush 31 along the moving direction of the conveying belt 3 need be set at least to L2>L1. In the image forming apparatus shown in FIG. 3, the distance is set to L2>>L1, and in the jam returning operation after occurrence of paper jam, the lubricating agent 32 is coated on the conveying belt 3 by the lubricating agent coating brush 31 while moving the conveying belt 3, and the lubricating agent coating brush 31 is moved away from the conveying belt 3 before the toner image formed on the conveying belt 3 arrives at the lubricating agent coating brush 31. Therefore, the lubricating agent coating brush 31 is not contaminated by the toner, and even if a large quantity of toners is stuck to the conveying belt 3, poor cleaning does not occur for a long period of time. Good belt cleaning can be realized.

Embodiment 6

The image forming apparatus applied in the present embodiment is a quadruple tandem system color printer employing an intermediate transfer belt as shown in FIG. 6. The constitution of the apparatus is similar to the color printer in Embodiment 3, and the basic printing operation is also similar thereto. Further, the material and properties of the intermediate transfer belt 4, and material and properties of the transfer roller 2 are also similar to those in Embodiment 3.

Figure 10:
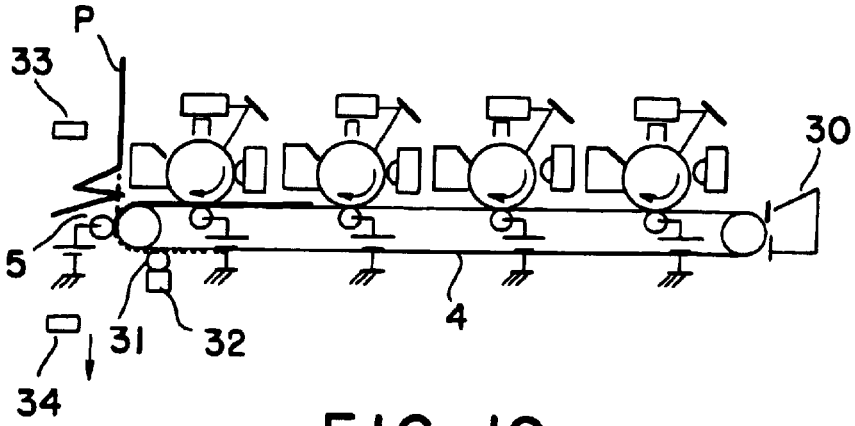
FIGS. 10, 11 and 12 are respectively explanatory views where paper jamming occurs in a quadruple tandem system color printer employing an intermediate transfer belt.

FIG. 10 shows the circumstances where the extreme end of paper P does not arrive at the paper detection sensor 34, and the paper jam occurred. In this case, the paper P is not held by the secondary transfer roller 5, and the paper P becomes a zigzag form, but a toner image is almost transferred to the secondary transfer roller 5, and a remained transfer toner remains on the intermediate transfer belt 4. Although the quantity of toner is small, but the toner remains on the intermediate transfer belt 4, because of which the lubricating agent coating brush 31 is moved away from the intermediate transfer belt 4. In the jam returning operation, the toner image in the region where when the paper jam occurs, a toner is not moved into the secondary transfer area moves into the cleaning blade 30*a*, and the cleaning blade 30*a* runs on the toner image, resulting in the occurrence of poor cleaning. For avoiding the poor cleaning, the lubricating agent coating brush 31 should be placed in contact and the lubricating agent 32 should be coated on the intermediate transfer belt 4, but the lubricating agent coating brush 31 is contaminated by the remained transfer toner, because of which the lubricating agent 32 cannot be coated.

Figure 11:
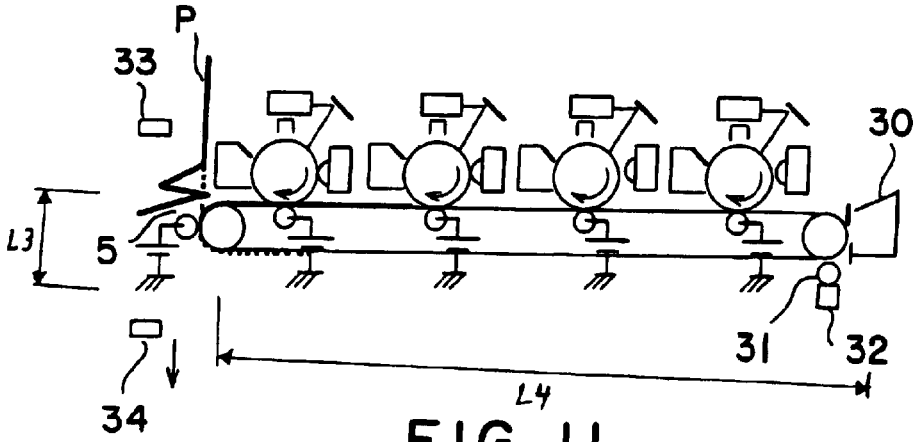

On the other hand, where the lubricating agent coating brush 31 is arranged sufficiently away from the secondary transfer area, as shown in FIG. 11, there is enough time till the remained transfer toner (indicated by the dotted line) not transferred to the secondary transfer roller 5 arrives at the lubricating agent coating brush 31 portion in the jam returning operation. So, if, in the jam returning operation, the lubricating agent coating brush 31 is placed in contact with the intermediate transfer belt 4 to coat the lubricating agent 32 on the intermediate transfer belt 4 till the intermediate transfer belt 4 starts to move, and the remained transfer toner arrives at the lubricating agent coating brush 31 portion, even if a large quantity of toners (indicated by the solid line) stuck to the intermediate transfer belt 4 moves into the cleaning blade 30*a*, poor cleaning does not occur.

As described above, distance L3 from the secondary transfer area to the paper detection sensor 34 portion and distance L4 from the secondary transfer area to the lubricating agent coating brush 31 along the moving direction of the intermediate transfer belt 4 are set to L4>L3, whereby even if the paper jam occurs, in the jam returning operation, the lubricating agent 32 can be coated on the intermediate transfer belt 4 by the lubricating agent coating roller 31, and even if a large quantity of toners moves into the belt cleaner 30, poor cleaning does not occur, and good cleaning can be realized.

Figure 12:
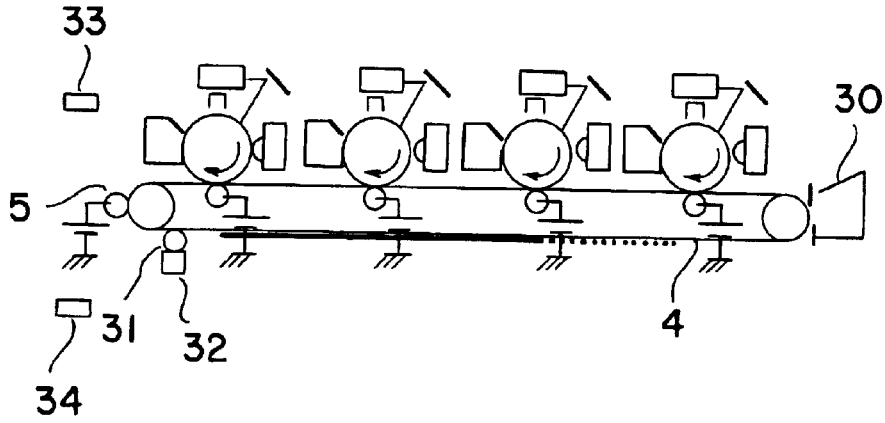

However, even if the lubricating agent coating brush 31 is arranged as shown in FIG. 10, measures against poor cleaning caused by the lubricating agent coating can be executed. In this case, as shown in FIG. 10, the remained transfer toner portion moves into the lubricating agent coating brush 31, but since the remained transfer toner is not so much in quantity, the lubricating agent coating brush 31 may be moved away from the intermediate transfer belt 4 simultaneously when the paper jam is detected. However, in the state that the bias voltage is applied to the secondary transfer roller 5, the secondary transfer roller 5 has to be placed in contact with the intermediate transfer belt 4 immediately before the intermediate transfer belt 4 is stopped. Because when the second transferring is terminated before the intermediate transfer belt 4 is stopped, the area to which a large quantity of toners is stuck moves into the lubricating agent coating brush 31 to contaminate the lubricating agent coating brush 31. After the start of the jam returning operation, as shown in FIG. 12, the lubricating agent coating brush 31 is moved away from the intermediate transfer belt 4, till the rear end of the toner image formed on the intermediate transfer belt 4 has passed the lubricating agent coating brush 31 portion, so as not to operate the brush 31, and naturally, the cleaning blade 30*a* is also moved away from the intermediate transfer belt 4. And, after the rear end of the toner image has passed the lubricating agent coating brush 31 portion, the lubricating agent coating brush 31 is placed in contact with the intermediate transfer belt 4 to coat the lubricating agent 32 on the intermediate transfer belt 4. Also with respect to the cleaning blade 30*a*, if after the rear end of the toner image has passed the cleaning blade 30*a* portion, the brush 31 comes into contact with the portion of the intermediate transfer belt 4 on which the lubricating agent 32 is coated to clean the toner image, cleaning can be carried out well.

Where the paper jam occurs, the toner image of a portion indicated by the dotted line in FIG. 11 becomes stuck to the secondary transfer roller 5, and if the printing operation is executed in that condition, paper-back contamination occurs, because of which it is necessary to clean the surface of the secondary transfer roller 5. As the method for cleaning the surface of the secondary transfer roller 5, employment of the blade cleaning system is contemplated. However, in the present embodiment, there is employed a system in which a (−) bias voltage which is reversal in polarity to the polarity normally applied is applied to the secondary transfer roller 5, a toner is transferred in reversal to the intermediate transfer belt 4, and toner is recovered by the belt cleaner 30.

As shown in FIG. 11, immediately after the start of the jam returning operation, a large quantity of toners remains on the intermediate transfer belt 4, and even if the toner stuck to the secondary transfer roller 5 is tried to be transferred in reversal to the toner remained portion, the reversal transferring cannot be done efficiently. Therefore, immediately after the jam returning operation has been started, the secondary transfer roller 5 is moved away from the intermediate transfer belt 4, the toner image (indicated by the bold line) formed on the intermediate transfer belt 4 has passed the secondary transfer roller 5 portion, after which it is placed in contact with the intermediate transfer belt 4 while applying a reverse-polarity bias voltage of −200 to −1000V to the secondary transfer roller 5, and the toner stuck to the secondary transfer roller 5 is transferred in reversal to the intermediate transfer belt 4.

As in the present embodiment, if the lubricating agent coating brush 31 is arranged at a position far from the distance L3 from the secondary transfer roller 5 to the paper detection sensor 34, the lubricating agent coating brush 31 is not contaminated by the toner transferred in reversal from the secondary transfer roller 5, and the lubricating agent 32 can be coated on the intermediate transfer belt 4. Moreover, since the toner transferred in reversal from the secondary transfer roller 5 in the state that the lubricating agent 32 is coated on the intermediate transfer belt 4 moves into the cleaning blade 30*a*, even if the toner transferred in reversal from the secondary transfer roller 5 is large in quantity, cleaning can be carried out sufficiently, and poor cleaning does not occur.

On the other hand, where the lubricating agent coating brush 31 is arranged in the vicinity of the secondary transfer area as shown in FIG. 10 in terms of a space, attention should be paid to the lubricating agent coating operation. A reverse bias voltage is applied to the secondary transfer roller 5 after the rear end of the toner image has passed the secondary transfer area, and the toner stuck to the secondary transfer roller 5 is transferred in reversal, because of which the lubricating agent coating brush 31 comes into contact with the intermediate transfer belt 4 immediately after the rear end of the toner image has been passed, and the operation for coating the lubricating agent 32 cannot be executed. After the rear end of the toner image is passed, and the toner is transferred in reversal from the secondary transfer roller 5, that is, after at least the secondary transfer roller 5 is rotated more than one round, the lubricating agent coating brush 31 is placed in contact with the intermediate transfer belt 4 to execute the lubricating agent coating operation. In this case, with respect to the cleaning blade 30*a*, the toner transferred in reversal from the secondary transfer roller 5 passes through the cleaning blade 30*a* portion, and the blade 30*a* has to be placed in contact with the intermediate transfer belt 4 portion on which the lubricating agent 32 is coated. That is, where cleaning of the secondary transfer roller 5 is carried out by applying the reverse bias voltage, if the lubricating agent coating brush 31 is arranged avoiding the reverse transfer toner so that the lubricating agent coating brush 31 is not contaminated by the toner transferred in reversal, there can be realized good belt cleaning free from the occurrence of the contamination of an image due to the contamination of the lubricating agent coating brush 31 by the toner, poor cleaning, blade burring and the like.

Embodiment 7

The image forming apparatus applied in the present embodiment is a quadruple tandem system color printer employing an intermediate transfer belt as shown in FIG. 6. The constitution of the apparatus is similar to the color printer in Embodiment 3, and the basic printing operation is also similar thereto. Further, the material and properties of the intermediate transfer belt 4, and the material and properties of the transfer roller 2 are also similar to those in Embodiment 3.

At the time of normal waiting and printing, the lubricating agent coating brush 31 is parted from the intermediate transfer belt 4, and only in the circumstances noted below, the brush 31 rotates while coming into contact with the intermediate transfer belt 4 to coat the lubricating agent 32 on the intermediate transfer belt 4. The image forming apparatus in the present embodiment has a counter which counts how many sheets are printed after carrying out the previous lubricating agent coating operation.

① When the intermediate transfer belt 4 or the belt cleaner 30 is exchanged with a new article.

② When, under the environments being x in TABLE 15 by a detected value of a temperature-humidity sensor installed within the image forming apparatus, the printing operation starts.

③ When, under the environments being A in TABLE 15 by a detected value of a temperature-humidity sensor installed within the image forming apparatus, a counted value of a counter exceeds 100 sheets.

④ When, under the environments being Δ in TABLE 15 by a detected value of a temperature-humidity sensor installed within the image forming apparatus, a counted value of a counter exceeds 1000 sheets.

⑤ When the paper jam occurs. Under the environments in which the lubricating agent coating time by the lubricating agent coating brush 31 is changed in the respective circumstances, resulting in that temperature is 30° C. and humidity is 85%, the occurrence circumstances of the blade burring and poor cleaning were investigated. The result is shown in TABLE 16.

From TABLE 16, in the circumstances of ①, ②, and ⑤, the operating time of the lubricating agent coating brush 31 may be 4 seconds, in the circumference of ③ being 3 seconds, and in the circumference of ④ being 2 seconds, whereby good cleaning could be carried out without occurring poor cleaning and blade burring.

While in the present embodiment, the operating time of the lubricating agent coating brush 31 has been changed to control the coating quantity of the lubricating agent 32, it is noted that the rotational speed of the lubricating agent coating brush 31 may be changed to control the coating quantity.

What is claimed is:

1. An image forming apparatus comprising:

means for forming a toner image on a photosensitive body;

a conveying belt for conveying a paper to a transfer area, conveying it while coming into contact with the photosensitive body, and transferring the toner image on the paper;

a cleaning blade for cleaning the surface of the conveying belt;

a lubricating agent coating mechanism for coating a lubricating agent on the surface of the conveying belt; and means for detecting or inputting the fact that said cleaning blade or said conveying belt is a new article, whereby when said detection or input means transmits a signal that the cleaning blade or the conveying belt is a new article to said lubricating agent coating mechanism, the lubricating agent coating mechanism operates to coat a lubricating agent on the surface of the conveying belt.

2. An image forming apparatus comprising:

means for forming a toner image on a photosensitive body;

an intermediate transfer body which moves while coming into contact with the photosensitive body the toner image being transferred to carry it once;

secondary transfer means for transferring the toner image on the intermediate transfer body to a paper;

a cleaning blade for cleaning the surface of the intermediate transfer body;

a lubricating agent coating mechanism for coating a lubricating agent on the surface of the intermediate transfer body; and means for detecting or inputting the fact that said cleaning blade or said intermediate transfer body is a new article, whereby when said detection or input means transmits a signal that the cleaning blade or the intermediate transfer body is a new article to said lubricating agent

TABLE 16

| Coating time | ① | | ② | | ③ | | ④ | | ⑤ | |
|---|---|---|---|---|---|---|---|---|---|---|
| (sec) | Burr | Poor | Burr | Poor | Burr | Poor | Burr | Poor | Burr | Poor |
| 1 | x | — | x | — | x | — | x | — | ○ | x |
| 2 | x | — | x | — | x | — | ○ | ○ | ○ | x |
| 3 | x | — | x | — | ○ | ○ | ○ | ○ | ○ | x |
| 4 | ○ | ○ | ○ | ○ | ○ | ○ | ○ | ○ | ○ | ○ |
| 5 | ○ | ○ | ○ | ○ | ○ | ○ | ○ | ○ | ○ | ○ |
| 6 | ○ | ○ | ○ | ○ | ○ | ○ | ○ | ○ | ○ | ○ |

coating mechanism, the lubricating agent coating mechanism operates to coat a lubricating agent on the surface of the intermediate transfer body.

3. An image forming apparatus comprising:

a toner image forming unit for forming a toner image on a photosensitive body;

a conveying belt for conveying a paper to a transfer area, conveying it while coming into contact with the photosensitive body, and transferring the toner image on the paper;

a cleaning blade for cleaning the surface of the conveying belt;

a lubricating agent coating mechanism for coating a lubricating agent on the surface of the conveying belt; and a detecting unit for detecting the fact that said cleaning blade or said conveying belt is a new article, whereby when said detecting unit transmits a signal that the cleaning blade or the conveying belt is a new article to said lubricating agent coating mechanism, the lubricating agent coating mechanism operates to coat a lubricating agent on the surface of the conveying belt.

* * * * *